US012256843B2

(12) United States Patent
Uhl

(10) Patent No.: US 12,256,843 B2
(45) Date of Patent: Mar. 25, 2025

(54) DECORATIVE KNOB COVER

(71) Applicant: Morgan Uhl, Lutz, FL (US)

(72) Inventor: Morgan Uhl, Lutz, FL (US)

( * ) Notice: Subject to any disclaimer, the term of this patent is extended or adjusted under 35 U.S.C. 154(b) by 0 days.

(21) Appl. No.: 18/213,547

(22) Filed: Jun. 23, 2023

(65) Prior Publication Data

US 2023/0413999 A1 Dec. 28, 2023

Related U.S. Application Data

(60) Provisional application No. 63/354,894, filed on Jun. 23, 2022.

(51) Int. Cl.
*A47B 95/02* (2006.01)

(52) U.S. Cl.
CPC ..... *A47B 95/02* (2013.01); *A47B 2095/028* (2013.01)

(58) Field of Classification Search
CPC ..... E05B 1/0053; E05B 1/0007; E05B 1/003; E05B 1/0061; E05B 1/0015; E05B 17/002; A47B 95/02; A47B 2095/024; A47B 2095/028
See application file for complete search history.

(56) References Cited

U.S. PATENT DOCUMENTS 1,755,234 A 4/1930 Westerfield
1,830,383 A * 11/1931 Bos ..... E05B 1/0061 16/86 A
2,131,067 A * 9/1938 Paden ..... E05B 1/0061 16/86 A
3,024,555 A * 3/1962 Abeles ..... E05B 1/0007 74/553
3,149,092 A 5/1966 Moojen
3,800,361 A 4/1974 Stauffer
D313,161 S 12/1990 Westphal
D322,550 S * 12/1991 Evans ..... D26/26
D336,584 S * 6/1993 Clacher ..... D8/322
D348,080 S 6/1994 Popovits
D349,445 S * 8/1994 Addison ..... D8/322
D374,300 S 10/1996 Germany
D375,631 S 11/1996 Strom
D382,009 S 8/1997 Miller, Jr.
(Continued)

FOREIGN PATENT DOCUMENTS

CN 209413454 9/2019
JP H0622475 U * 3/1994
(Continued)

OTHER PUBLICATIONS

Master Magnetics, Master Magnetics Round Base Magnet Fastener with Knob,Chrome, 1.43" Diameter, 0.98" Total Height with 1" Diameter Knob/16 Pounds,(Box of 4), HMKR-45X4, May 17, 2022.

(Continued)

*Primary Examiner* — Chuck Y Mah
(74) *Attorney, Agent, or Firm* — Akerman LLP; Alejandro Fernandez

(57) ABSTRACT

Removable, decorative knob covers configured to connect to an existing knob are described. In one embodiment, the decorative knob covers have an elastomeric shaft that is friction fit over an existing, fixed knob. In another embodiment, the decorative knob covers attach to an existing, fixed knob by a clasp.

11 Claims, 5 Drawing Sheets

(56) References Cited

U.S. PATENT DOCUMENTS

| | | | | |
|---|---|---|---|---|
| 5,701,635 | A * | 12/1997 | Hawkes | E05C 17/52 16/86 A |
| 5,713,615 | A * | 2/1998 | Tsai | E05B 1/0061 292/347 |
| D402,875 | S * | 12/1998 | Bethea | D8/322 |
| D427,046 | S * | 6/2000 | Mannix | D8/322 |
| D433,307 | S | 11/2000 | Hickman | |
| 6,185,785 | B1 * | 2/2001 | Kingston | E05B 1/0015 40/406 |
| D464,159 | S | 10/2002 | Peloquin | |
| D489,477 | S | 5/2004 | Maldonaldo | |
| 6,729,740 | B1 * | 5/2004 | Gazard | E05B 17/10 362/311.03 |
| 6,842,946 | B2 | 1/2005 | Hayden | |
| D509,041 | S | 9/2005 | Larkin | |
| 7,111,365 | B1 | 9/2006 | Howie, Jr. | |
| 7,246,413 | B2 | 7/2007 | Portelli | |
| D550,059 | S | 9/2007 | Witte | |
| D637,884 | S | 5/2011 | Trotta | |
| D640,952 | S | 7/2011 | Rasmussen | |
| D646,550 | S * | 10/2011 | Owens | D8/305 |
| 8,132,295 | B1 | 3/2012 | Otis et al. | |
| 8,353,085 | B2 * | 1/2013 | Balzano | A47K 5/12 16/904 |
| 8,360,488 | B2 | 1/2013 | Forrest et al. | |
| D707,009 | S | 6/2014 | Walter | |
| D746,377 | S | 12/2015 | Au | |
| D767,060 | S | 9/2016 | Murphy, Jr. | |
| D770,877 | S | 11/2016 | Pitchforth | |
| 10,352,512 | B1 * | 7/2019 | Smith | F21V 23/0471 |
| 10,422,157 | B1 * | 9/2019 | Lindstead | E05B 1/0053 |
| D867,103 | S | 11/2019 | Griswold | |
| 10,477,968 | B2 | 11/2019 | Maier et al. | |
| 10,638,095 | B1 * | 4/2020 | Wallace | H04N 7/141 |
| D887,247 | S | 6/2020 | Luo | |
| D910,415 | S | 2/2021 | Smither | |
| D960,683 | S * | 8/2022 | Swartz | D8/305 |
| 11,408,211 | B1 | 8/2022 | Shaffer | |
| D973,993 | S | 12/2022 | Hunter | |
| D974,147 | S * | 1/2023 | Swartz | D8/322 |
| 2004/0078933 | A1 | 4/2004 | Forrest | |
| 2005/0034270 | A1 * | 2/2005 | Newman | E05B 1/04 16/110.1 |
| 2006/0006678 | A1 * | 1/2006 | Herron | E05B 1/0069 292/336.3 |
| 2006/0044790 | A1 | 3/2006 | Crawley | |
| 2006/0202484 | A1 * | 9/2006 | Lignell | E05B 13/001 292/336.3 |
| 2007/0069090 | A1 | 3/2007 | Driscoll | |
| 2010/0139046 | A1 | 6/2010 | Daniels et al. | |
| 2012/0167347 | A1 * | 7/2012 | Bigajer | B25G 1/00 16/422 |
| 2013/0125345 | A1 | 5/2013 | Specht | |
| 2014/0173867 | A1 | 6/2014 | Strombeck | |
| 2017/0260073 | A1 | 9/2017 | Kim | |
| 2017/0350160 | A1 * | 12/2017 | Block | E05B 17/226 |
| 2018/0246539 | A1 * | 8/2018 | Robichaud | G05G 1/10 |
| 2018/0332992 | A1 * | 11/2018 | Chong | A47G 29/00 |
| 2022/0119028 | A1 | 4/2022 | Hopkins | |
| 2023/0413999 | A1 | 12/2023 | Uhl | |

FOREIGN PATENT DOCUMENTS

| | | | |
|---|---|---|---|
| JP | H11256891 | A * | 9/1999 |
| JP | 2006249900 | A * | 9/2006 |
| KR | 200178536 | Y1 * | 4/2000 |
| KR | 20100046442 | A * | 5/2010 |
| TW | 225132 | | 6/1994 |
| TW | 306215 | | 5/1997 |

OTHER PUBLICATIONS

Peppermint Stick Handlez, retrieved Nov. 13, 2024, www.instagram.com/p/CxiVCb3sfEE/?hl=en (Sep. 23, 2023).

* cited by examiner

DECORATIVE KNOB COVER

CROSS-REFERENCE TO RELATED INVENTIONS

This application claims priority benefit to U.S. Provisional Application No. 63/354,894, filed Jun. 23, 2022, which is incorporated herein by reference in its entirety.

FIELD OF THE DISCLOSURE

The present disclosure relates generally to knobs used on cabinets, drawers and other devices requiring user control.

BACKGROUND

Knobs are commonplace in households and countless other environments. Conventional knobs are fixed to drawers or doors to facilitate moving the drawer or door between an open and a closed position. Given their prevalence and visibility, knobs are often provided in decorative finishes, patterns or designs intended to complement the location where the knob is fixed.

Unfortunately, conventional knobs have a number of drawbacks and shortcomings. For example, removal and replacement of conventional designs is costly in terms of material expenses, time-consuming and requires tools. As a result, given these characteristics, users replace conventional knobs infrequently. Over time, such knobs become outdated, outmoded and unsightly.

Indeed, in a number of known prior art references, others have attempted to improve upon such drawbacks. For example, U.S. Pat. No. 8,132,295, discloses interchangeable, customizable pull mechanisms. Such pulls implement a knob cover replacement. In another example, depicted in U.S. Pat. No. 10,477,968, an interchangeable, customizable knob is disclosed. The knob includes a stem and insert with a locking slot that permits a user to replace the front face of the knob. In yet another example, depicted in U.S. Pat. Publ. No. US 2007/0069090, a knob is depicted with a knob body and a decorative, interchangeable attachment. The knob body includes a peripheral portion and a central portion, the central portion including a magnetic surface. As such, the interchangeable attachment is magnetically affixed to the knob body.

Each of these approaches to decorative knobs, however, suffers from one or more drawbacks of its own. Most notably, the knobs are not configured for use when their decorative attachments are removed. That is, upon removal of the decorative attachment, what is left is a non-functional stem or knob body that looks incomplete and is unsightly, thus rendering them ineffective for their intended use. Moreover, such approaches require highly customized attachments, which are not useable across a wide variety of existing knobs. As a result, to use such knobs requires replacement of all knob hardware with a new set of fixed knobs. What is needed, therefore, is a device that overcomes or improves upon the foregoing and various other drawbacks and deficiencies in conventional knobs.

SUMMARY

To improve upon the drawbacks and deficiencies of known knobs, the present disclosure provides a decorative knob cover that provides a friction-fitted attachment to an existing knob without compromising the existing knob's function and purpose. In one embodiment, the present disclosure describes a decorative knob for use with a fixed knob, the decorative knob having a fitting. The fitting forms a shaft with a first end, a second end and a passageway therebetween. The first end and the passageway are made from an elastomeric material such as a thermoplastic elastomer. This permits a friction-fit attachment to the existing knob. In addition, a handle is provided. The handle is connected to the fitting, and has a first side and a second side, the first side being affixed to the second end of the shaft. The second side of the handle has a decorative surface.

In another embodiment, a clasp is disclosed as an alternative mechanism to secure the knob to an underlying knob. Other alternative embodiments include light emitting diode or sound emitting speaker features, as well as ergonomic features. The present summary should not be construed to in any way narrow or constrain the claims of this disclosure, which alone define the scope of the inventions disclosed herein.

DETAILED DESCRIPTION OF THE PREFERRED EMBODIMENTS

Parts List

Cabinet (2)
Dresser (3)
Drawer (4)
Fixed Knob (6)
Door (8)
Decorative knob cover (10)
Grip (14)
Fitting (18)
Decoration (22)

The following detailed description and the appended figures describe and illustrate features, structural characteristics, or operational characteristics of certain embodiments for the purpose of enabling one of ordinary skill in the relevant art to understand the disclosure. As such, the detailed description and figures are purely representative in nature and are not intended to limit the scope of the features described herein. It should also be understood that the figures may not be to scale and in certain instances details may have been omitted, which are not necessary for an understanding of the disclosed embodiments. In the accompanying figures, like numerals generally represent like components.

Figure 1:
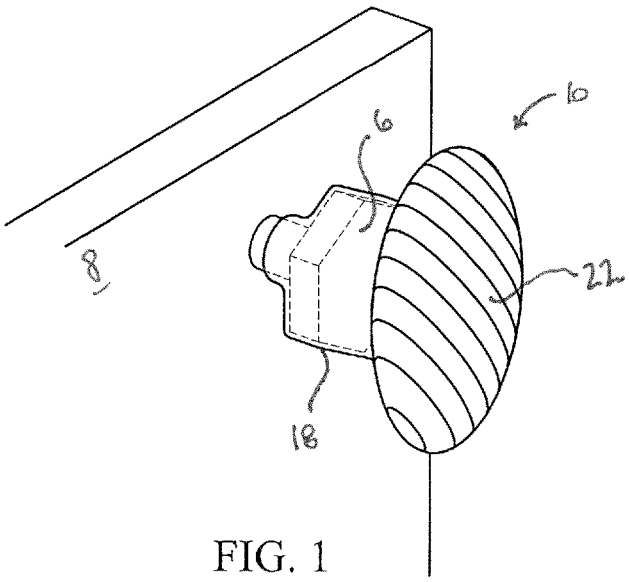
FIG. 1 illustrates a perspective side view of a decorative knob cover.
Figure 2:
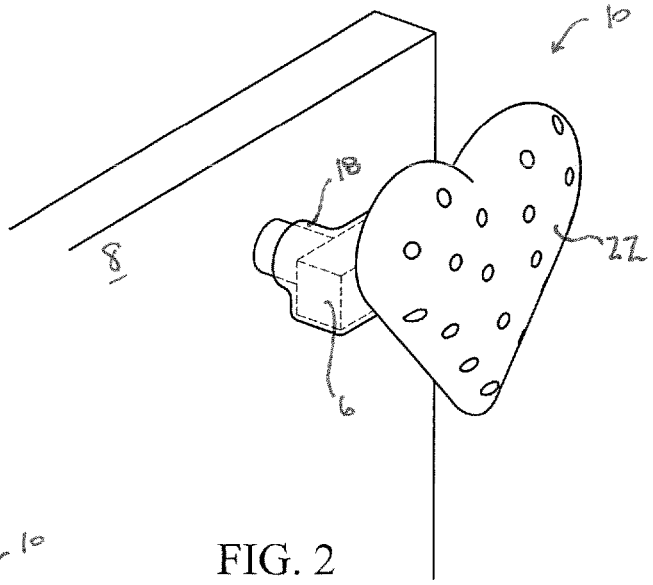
FIG. 2 illustrates a perspective side view of a decorative knob cover.
Figure 3:
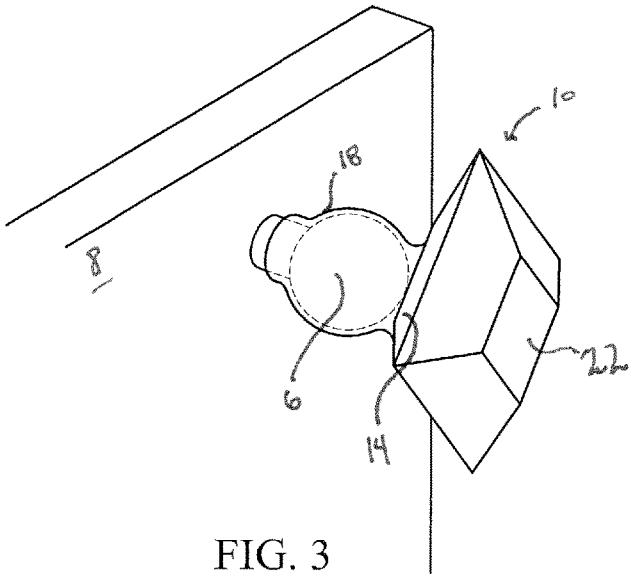
FIG. 3 illustrates a perspective side view of a decorative knob cover.

In one preferred embodiment, shown in FIGS. 1-3, a decorative knob cover 10 includes a grip 14, a fitting 18, and a decoration 22. In use, knob cover 10 is friction-fit over existing hardware, such as a fixed knob 6 connected to a door 8 or drawer 4. Accordingly, multiple and differing knob covers 10 can be used to decorate a variety of cabinets and drawers, as shown in FIGS. 6-10. Because of their ease of use and interchangeability, knob cover 10 is particularly well-suited for themed use. For example, knob cover 10 can be configured for various themes, including: holidays such as Christmas or Hannukah; special occasions such as birthdays or anniversaries; and boy's or girl's rooms. They can also be configured in modern, antique or other styles so as to coincide and harmonize with existing hardware and room décor.

Referring to FIGS. 1-3, knob cover 10 includes a fitting 18, which is made of a deformable material such as an elastic polymer or rubber. This allows a user to either press fitting 18 over knob 6, or evert fitting 18 and revert it onto knob 6, as shown in FIGS. 2-3 and 11-12. Given the deformable fitting, knob cover 10 can be used on a wide variety knobs 6 having different shapes and sizes, as shown in FIGS. 1, 2 and 3. Once fitting 18 is mated with or disposed over knob 6, a friction-fit connection retains knob cover 10 on knob 6. In the event a user wants to remove knob cover 10, the user may hold the door/drawer in a fixed position, while pulling on grip 14 in a direction away from door 8 with sufficient force to overcome the friction-fit retention force.

The friction-fit connection is sufficiently strong to withstand repeated opening and closing of the door 8 or drawer 4 by a user. Moreover, the cylindrical configuration of fitting 18 enhances the retaining force of knob cover 10 on knob 6 during opening of the door/drawer, thus improving retention of knob cover 10, and preventing inadvertent detachment from knob 6. Likewise, the cylindrical configuration of fitting 18 causes retention of knob cover 10 on knob 6 during closing of the door/drawer, thus also preventing knob cover 10 from inadvertently detaching as a door/drawer is closed.

Figure 4:
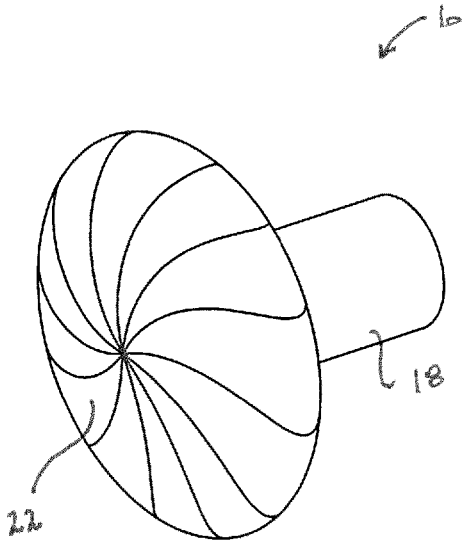
FIG. 4 illustrates a perspective side view of a decorative knob cover.
Figure 5:
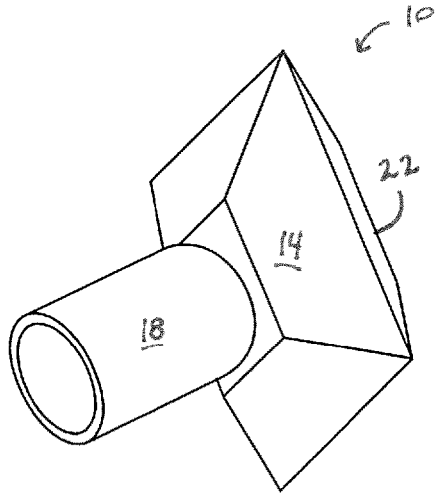
FIG. 5 illustrates a perspective rear view of a decorative knob cover.

Referring to FIGS. 4 and 5, knob cover 10 is provided with a decoration 22, a grip 14 (FIG. 5) and a fitting 18. Decoration 22, grip 14 and fitting 18 can be configured as separate parts that are glued or otherwise attached to each other, or alternatively, the entirety of knob cover 10 can be formed from a unitary piece of material, such as a thermoplastic elastomer. Preferred materials include, for example, polymers, thermoplastic elastomers, or naturally-derived materials. Such materials can be dishwasher safe so that knob cover 10 can be readily cleaned after use in children's rooms, kitchens or garages. Decoration 22, in particular, can be provided with different etchings, colors or other design features to provide a desired theme or appearance. For example, light emitting diodes that flash or create ambient lighting upon sensing movement or touch can be embedded into the knobs during manufacture. Alternatively, small speakers that play holiday or special event music upon sensing movement or touch can also be used. In one embodiment, a pinwheel or candy cane "swirl" configuration can be provided (FIG. 4), whereas in another, a multi-faceted gem or diamond configuration can be provided (FIG. 5).

Figure 6:
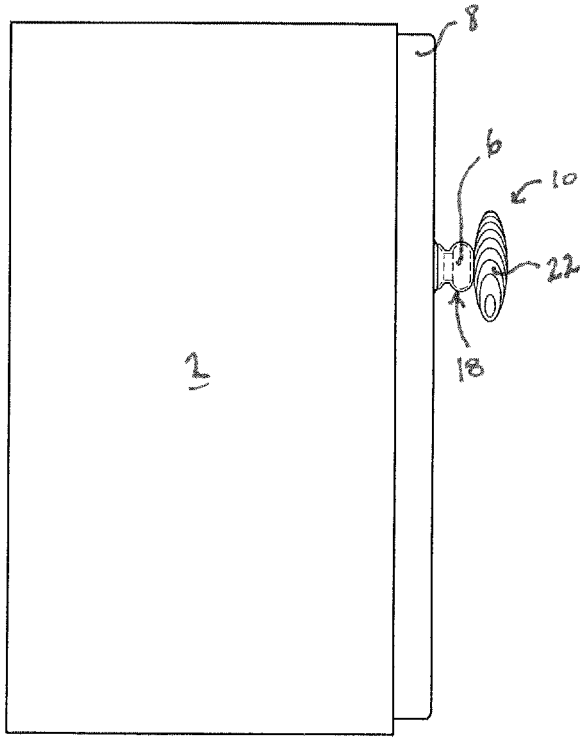
FIG. 6 illustrates a side view of a decorative knob cover on a cabinet door.
Figure 7:
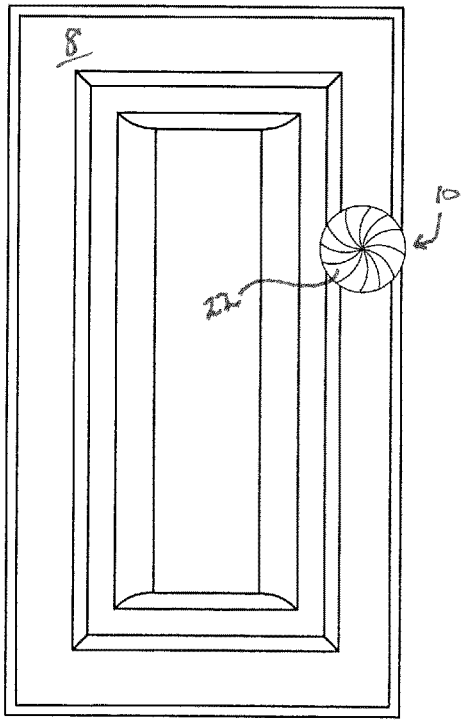
FIG. 7 illustrates a front view of a decorative knob cover on a cabinet door.
Figure 8:
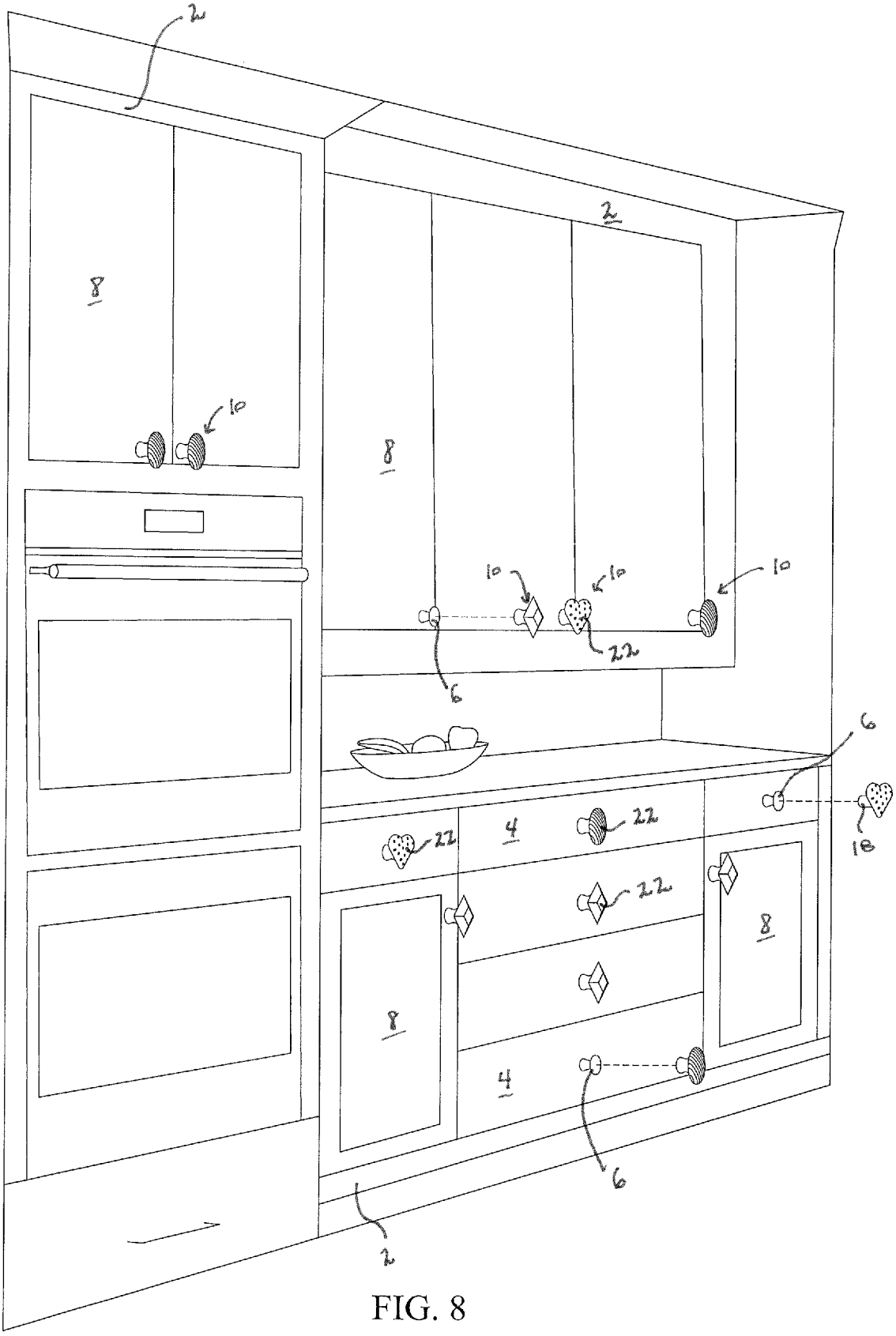
FIG. 8 illustrates a perspective side view of a plurality of decorative knob covers on cabinet door and drawers.
Figure 9:
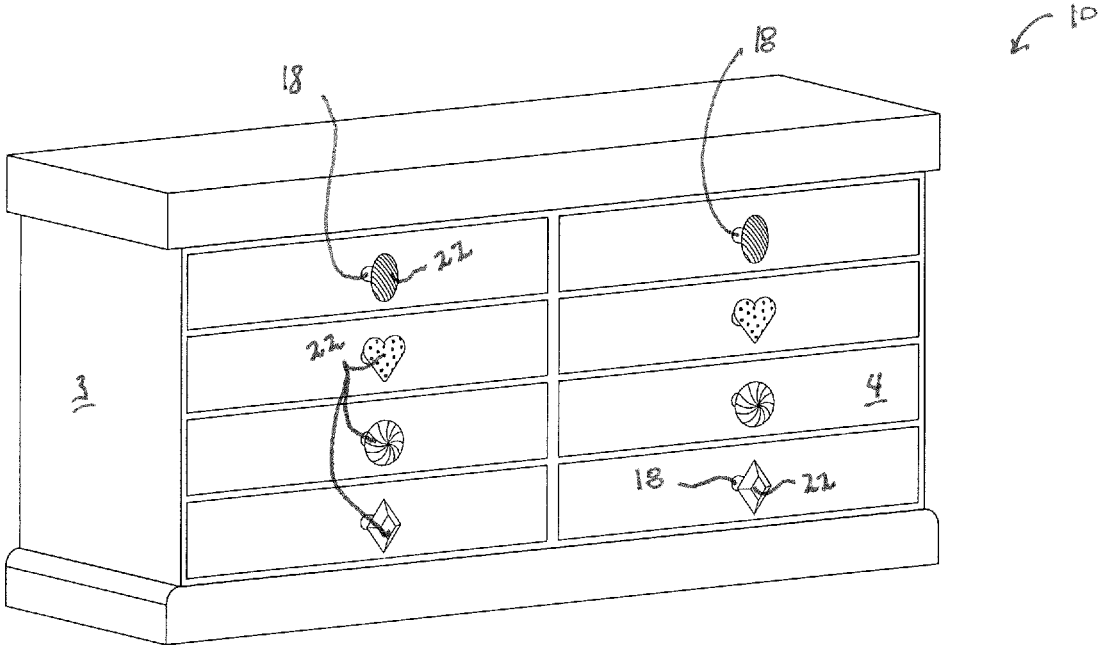
FIG. 9 illustrates a perspective side view of a plurality of decorative knob covers on dresser drawers.
Figure 10:
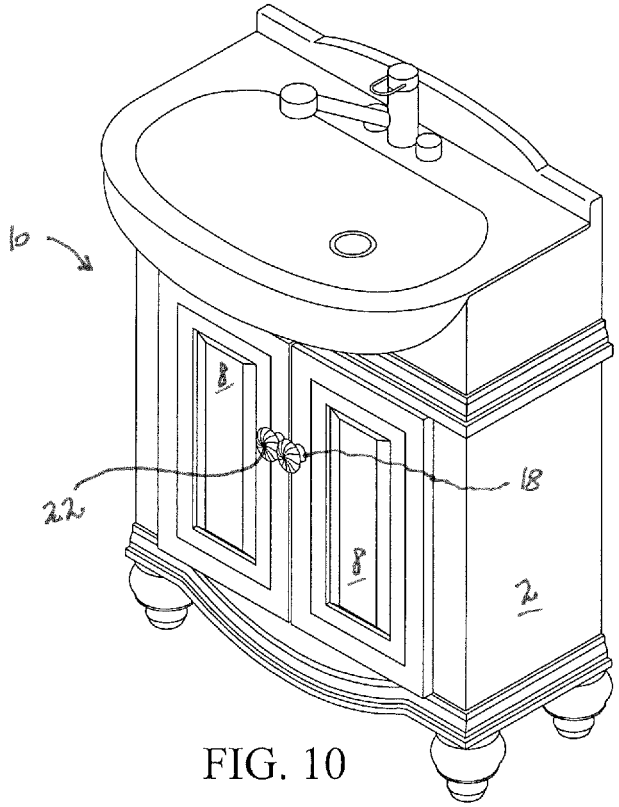
FIG. 10 illustrates a perspective side view of a plurality of decorative knob covers on sink cabinet doors.
Figure 11:
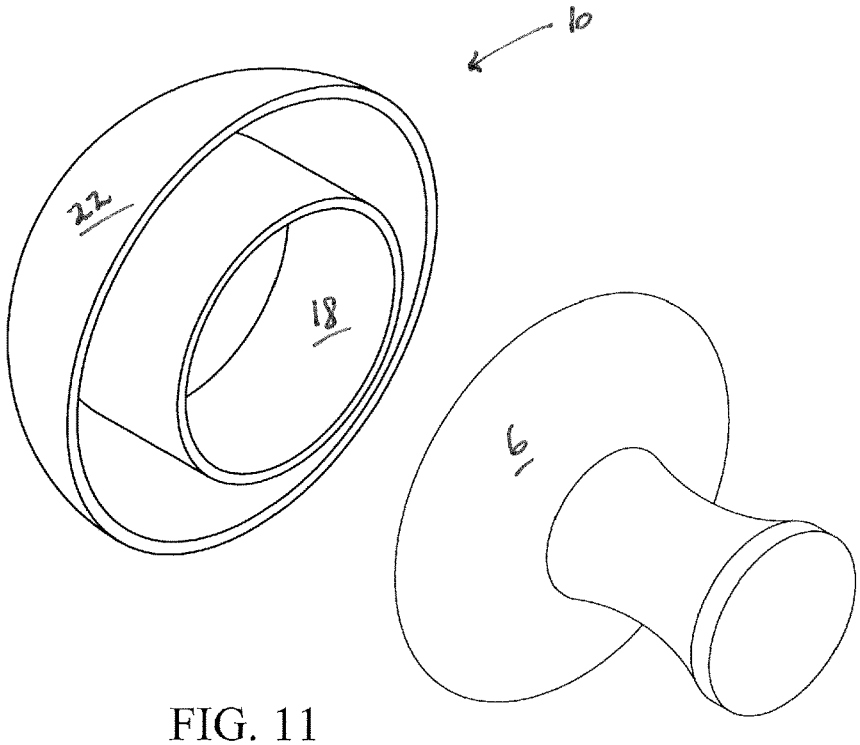
FIG. 11 illustrates a perspective rear view of a decorative knob cover and a knob.
Figure 12:
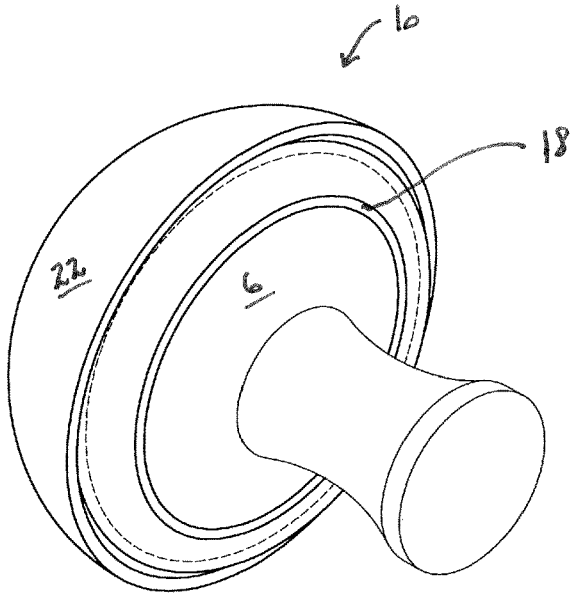
FIG. 12 illustrates a perspective rear view of a decorative knob cover attached to a knob.

In use, knob cover 10 can be friction-fit onto doors 8 on cabinet 2 (e.g., FIG. 6, 8, or drawers 4 on dresser 3 (e.g., FIG. 9). When used in combination, as depicted in FIGS. 8-9, multiple knob covers 10 having different decorations 22 can provide a winsome appearance to "dress up" an entire area (FIG. 8), or a single piece of furniture (FIG. 9). Indeed, the use of themed knob covers 10 can create a festive atmosphere for a holiday or special occasion. As alternatively shown in FIG. 10, matching knob covers 10 can be used to provide a more uniform look to a piece of furniture, such as a sink cabinet 2.

Alternatively, knob cover 10 can be provided in oversized or ergonomic configurations that facilitate opening and closing drawers and doors by individuals living with a disability or that have trouble reaching a particular knob. In yet another alternative, knob cover can be provided with a clasp or clip mechanism that clasps or clips onto knob 6, instead of a cylindrical configuration. In another alternative, depicted in FIGS. 11-12, a knob cover 10 includes a decorative cover 22, an internal fitting 18 projecting from the decorative cover, and a knob 6. As in other embodiments, an thermoplastic elastomer fitting 18 can be manually everted or stretched and attached to knob 6. It can be removed by simply holding the drawer or door to which knob 6 is attached, while removing the knob cover from the knob.

The descriptions set forth above are meant to be illustrative and not limiting. Various modifications of the disclosed embodiments, in addition to those described herein, will be apparent to those skilled in the art from the foregoing description. Such modifications are also intended to fall within the scope of the concepts described herein. The disclosures of each patent, patent application and publication cited or described in this document are hereby incorporated herein by reference, in their entireties.

The foregoing description of possible implementations consistent with the present disclosure does not represent a comprehensive list of all such implementations or all variations of the implementations described. The description of some implementation should not be construed as an intent to exclude other implementations. For example, artisans will understand how to implement the disclosed technologies and techniques in many other ways, using equivalents and alternatives that do not depart from the scope of the present disclosure. It is thus intended that the embodiments disclosed in the specification be considered as illustrative or representative only, with a true scope and spirit of the features described in this disclosure being indicated by the following claims.

What is claimed is:

1. A decorative knob cover for use with a fixed knob for cabinets or drawers, the decorative knob cover comprising:

a fitting comprising an elastomeric shaft, the shaft having a first end, a second end and a passageway therebetween, wherein the fitting is adapted for a friction-fit attachment to the fixed knob; and a handle connected to the fitting, the handle comprising a first side and a second side, the first side being affixed to the second end of the shaft, and the second side having a decorative surface.

2. The knob cover of claim 1, wherein the fitting is formed of thermoplastic elastomer.

3. The knob cover of claim 2, wherein the shaft is cylindrical.

4. The knob cover of claim 1, wherein the decorative surface is configured as a Christmas tree.

5. The knob cover of claim 1, wherein the decorative surface forms a wreath.

6. The knob cover of claim 1, wherein the decorative surface forms a light bulb.

7. The knob cover of claim 1, wherein the decorative surface forms a candy cane.

8. The knob cover of claim 1, wherein the decorative surface forms at least one letter.

9. The knob cover of claim 1, wherein the decorative surface forms a balloon.

10. The knob cover of claim 1, wherein the handle comprises a light emitting diode connected to the decorative surface.

11. The knob cover of claim 1, wherein the handle comprises a sound emitting device connected to the decorative surface.

* * * * *